United States Patent [19]

Damman

[11] 4,162,596

[45] Jul. 31, 1979

[54] ANCHOR BOLT ASSEMBLY

[76] Inventor: Bernard A. Damman, 6700 Puttygutt, St. Clair, Mich. 48079

[21] Appl. No.: 831,383

[22] Filed: Sep. 8, 1977

[51] Int. Cl.[2] ..... E04B 1/38

[52] U.S. Cl. ..... 52/295; 52/704; 52/714; 248/634; 248/679

[58] Field of Search ..... 52/704, 706, 295, 699, 52/714; 248/10, 20, 22

[56] References Cited

U.S. PATENT DOCUMENTS

| | | | |
|---|---|---|---|
| 3,735,665 | 5/1973 | Mortensen | 52/345 |
| 3,829,540 | 8/1974 | Cox | 52/295 |

FOREIGN PATENT DOCUMENTS

| | | | |
|---|---|---|---|
| 888202 | 1/1962 | United Kingdom | 52/707 |

*Primary Examiner*—James L. Ridgill, Jr.
*Attorney, Agent, or Firm*—Gifford, Chandler, VanOphem, Sheridan & Sprinkle

[57] ABSTRACT

An anchor bolt assembly is provided and comprises an anchor bolt having a threaded end and an anchor end wherein the anchor end is embedded in a suitable base material while the threaded end protrudes upwardly and outwardly from the base material. A tubular resilient sleeve is positioned annularly around the anchor bolt between its ends so that the sleeve is disposed between the base material and a portion of the anchor bolt. The resilient sleeve permits radial displacement of the anchor bolt relative to the base material while maintaining firm engagement between the anchor bolt and the base material.

3 Claims, 3 Drawing Figures

ANCHOR BOLT ASSEMBLY

BACKGROUND OF THE INVENTION

I. Field of the Invention

The present invention relates to an improved anchor bolt assembly.

II. Description of the Prior Art

Anchor bolts have been long employed in building construction to secure static structures or the like to a suitable base, typically poured concrete. These previously known anchor bolts include an anchor end embedded in the concrete and a threaded end which extends upwardly and outwardly from the concrete base. The static structure is positioned over and secured to the threaded end of the anchor bolt by suitable nut members.

These previously known anchor bolts, however, have encountered special difficulties and problems when employed in climates with wide temperature variations, such as might be found in the arctic regions. Under these conditions, the previously known anchor bolts are subjected to relatively large and continuous bending and radial displacement due to cyclic thermal expansion and contraction of the static structure. The cyclic bending of these previously known anchor bolts has resulted in loosening, breakage, fracture and other structural damage to both the anchor bolts and the static structure.

There have been previously known anchor bolt assemblies, such as described in U.S. Pat. No. 3,829,540, in which a sleeve is positioned around the anchor bolt to permit misalignment compensation for the anchor bolt. In this aforementioned patent, the sleeve is constructed from a permanently deformable plastic material. However, this previously known permanently deformable sleeve has not proven successful for cyclic thermal expansion and contraction since the sleeve, once deformed, remains permanently deformed. Consequently, cyclic radial displacement of the anchor bolt due to thermal expansion results not only in the virtually complete deformation of the sleeve, but also in localized stress points on the anchor bolt. These localized stress points on the anchor bolt not only cause a loosening of the anchor bolt but also can even result in fracture and breakage of the anchor bolt at these localized stress points.

SUMMARY OF THE INVENTION

The present invention overcomes the above-mentioned disadvantages of the previously known anchor bolts by providing an anchor bolt assembly which permits repeated thermal expansion and contraction of the static structure.

In brief, the anchor bolt assembly according to the present invention comprises an anchor bolt having an anchor end and a threaded end. In the usual fashion the anchor end of the anchor bolt is embedded in a suitable base material, typically concrete, while the threaded end extends outwardly from the concrete base. The anchor bolt is positioned within the concrete base so that the threaded end of the anchor bolt registers with receptive holes formed in the bottom of the static structure to be secured to the base.

A tubular resilient sleeve, preferably made of hard rubber, is disposed annularly around the anchor bolt between its ends so that the threaded end extends outwardly from the resilient sleeve while the sleeve itself is embedded in the concrete base.

The sleeve, due to its resiliency, permits the anchor bolt to bend or radially displace in response to the thermal expansion and contraction of the static structure without deformation of the sleeve. Moreover, due to its resiliency and its relatively large area of contact with the anchor bolt, the resilient sleeve prevents the formation of localized stress points on the anchor bolt from repeated cyclic bending and instead distributes the bending force of the anchor bolt over its relatively large area of contact with the resilient sleeve. This distribution of forces thus prevents structural fatigue, fracture and the previously known breakage of the anchor bolt.

The resiliency of the sleeve further serves to securely hold the anchor bolt within the concrete and prevent the previously known loosening of the anchor bolt in the concrete base.

BRIEF DESCRIPTION OF THE DRAWING

The anchor bolt assembly according to the present invention will be more fully understood upon reference to the following detailed description when read in conjunction with the accompanying drawing, wherein like reference characters refer to like parts throughout the several views and in which.

DETAILED DESCRIPTION OF THE PRESENT INVENTION

Figure 1:
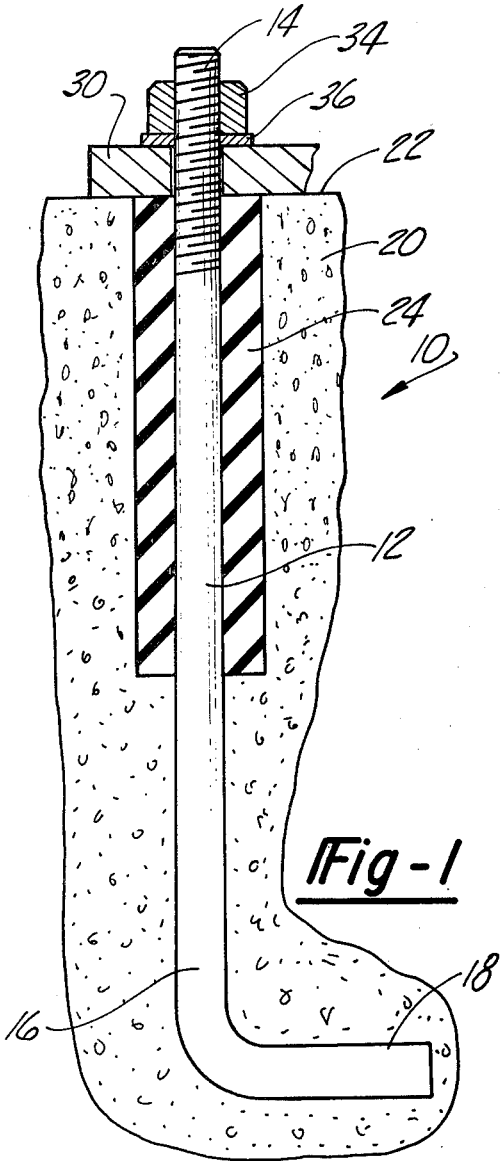
FIG. 1 is a side fragmentary sectional view illustrating the anchor bolt assembly according to the present invention.

With reference to the drawing, an anchor bolt assembly 10 according to the present invention is thereshown and comprises an anchor bolt 12 having an upper threaded end 14 and a lower anchor end 16. The anchor bolt 12 is circular in cross-sectional shape while the anchor end 16 of the bolt 12 is formed into a right angle extension 18. It will be understood, however, that any conventional anchor end 16 for the anchor bolt 12 is within the scope of the present invention.

The anchor bolt 12 is embedded in a base 20, typically poured concrete, so that at least a portion of the upper threaded end 14 of the anchor bolt 12 extends outwardly from the top surface 22 of the base 20. With the anchor bolt 12 embedded in the concrete base 20, the anchor end 16 of the bolt 12 prevents retraction of the bolt from the base 20.

A resilient tubular sleeve 24 is disposed around the anchor bolt 12 between its ends so that the sleeve 24 is encased within the concrete base 20. Thus, the upper threaded end 14 of the anchor bolt 12 extends outwardly above both the upper surface 22 of the base 20 and the upper surface of the tubular sleeve 24 while the anchor end 16 of the anchor bolt extends outwardly through the other end of the tubular sleeve 24. The sleeve 24, as previously mentioned, is constructed of a resilient material, such as hard rubber or the like.

The upper threaded end 14 of the anchor bolt 12 is received through a receptive hole 28 formed in the base 30 of a structure 32. Thereafter, a nut 34 and washer 36 secure the structure 32 onto the anchor bolt 12 by the nut 34 threadably engaging the threaded end 14 of the bolt 12. The support structure 32 can be any suitable support such as, for example, a pipeline support.

The anchor bolt assembly 10 of the present invention can be advantageously employed in arctic environments in which the structure 32 and the anchor bolt assembly 10 are subjected to wide temperature variations. During such wide temperature variation, the support structure 32 thermally contracts and expands which imposes radial forces upon and radially displaces or bends bolt 12. Such bending has previously resulted in loosening and even breakage of the anchor bolt.

Figure 2:
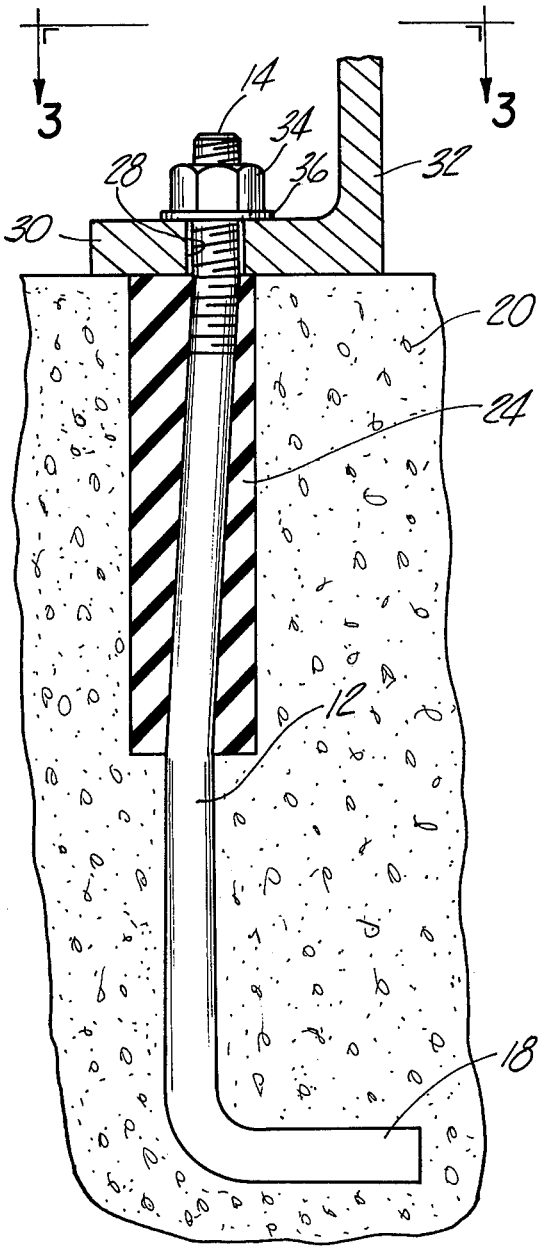
FIG. 2 is a sectional view similar to FIG. 1 but showing the anchor bolt radially displaced.
Figure 3:
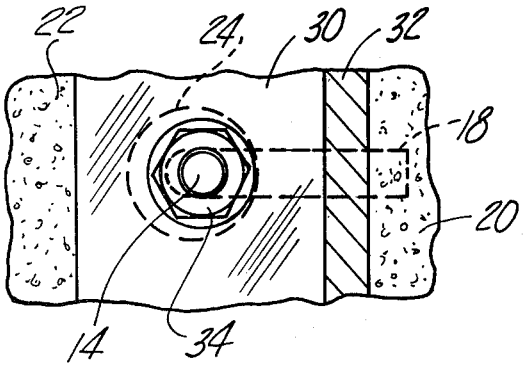
FIG. 3 is a fragmentary plan view taken substantially along line 3—3 in FIG. 2.

With reference to FIG. 2, the thermal expansion or contraction of the static structure 32 is thereshown bending the anchor bolt 12 rightwardly. However, unlike the previously known anchor bolts, the bending of the anchor bolt 12 merely results in the compression of the tubular sleeve 24. In doing so, the resilient sleeve 24 distributes the radial force imposed on the anchor bolt 12 over a relatively large axial length of the anchor bolt 12 and thus prevents localization of stress points along the anchor bolt 12 from the bending. This distribution of forces effectively prevents loosening, structural fatigue, and fracture of the anchor bolt 12.

When the thermal expansion or contraction of the static structure 32 is reversed from the position shown in FIG. 2, the anchor bolt 12 is returned to the position illustrated in FIG. 1. Due to the resiliency of the sleeve 24, the sleeve 24 expands and maintains firm contact with the anchor bolt 12. Consequently, the anchor bolt 12 can be subjected to repeated cyclic radial displacement due to the thermal expansion and contraction of the static structure 32 during which time the sleeve maintains firm contact with the anchor bolt 12 and prevents the localization of stress points on the anchor bolt 12 from bending.

The resilient sleeve 24 is preferably precompressed around the anchor bolt 12. This precompression of the sleeve 24 provides a water tight seal between the sleeve 24 and the anchor bolt 12. Previously, water seepage along the anchor bolt 12 has loosened the anchor bolt during expansion upon freezing.

It can thus be seen that the resilient sleeve 24 around the anchor bolt 12 advantageously prevents the localization of stress forces on the anchor bolt 12. Moreover, due to the resiliency of the sleeve 24, the anchor bolt 12 can thus be subjected to repeated cyclic bending without loosening or causing structural fatigue to the anchor bolt 12.

As a further advantage, the resilient sleeve 24 forms a water tight seal around the anchor bolt 12 which prevents water seepage along the bolt 12. Such water seepage along the anchor bolt 12 expands upon freezing and loosens the previously known anchor bolts.

Having described by invention, many modifications thereto will become apparent to those skilled in the art to which it pertains without deviation from the spirit of the invention as defined by the scope of the appended claims.

I claim:

1. An anchor bolt assembly comprising:

an anchor bolt having a threaded end and an anchor end;

a tubular sleeve having an internal bore positioned annularly around and extending along said bolt between the ends thereof, said ends of said bolt projecting outwardly from the ends of said sleeve, wherein said sleeve is constructed of a resilient hard rubber material, said sleeve being radially inwardly compressed around said anchor bolt to thereby form a fluid seal between said sleeve and said anchor bolt so that the internal bore of said sleeve remains substantially entirely in contact with the anchor bolt despite radial displacement of the anchor bolt to thereby maintain the fluid seal between said sleeve and said bolt.

2. The invention as defined in claim 1 wherein said anchor bolt assembly is partially embedded in a base material so that the threaded end extends outwardly from said base material.

3. The invention as defined in claim 2 wherein said base material is concrete.

* * * * *

UNITED STATES PATENT AND TRADEMARK OFFICE

CERTIFICATE OF CORRECTION

PATENT NO. : 4,162,596

DATED : July 31, 1979

INVENTOR(S) : Bernard A. Damman

It is certified that error appears in the above-identified patent and that said Letters Patent are hereby corrected as shown below:

Column 4, line 13, delete "by" and insert --my-- therefor.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*